US008424332B2

(12) United States Patent
Yamasaki et al.

(10) Patent No.: US 8,424,332 B2
(45) Date of Patent: Apr. 23, 2013

(54) MODULAR REFRIGERATOR INSTALLED BY HOOKS

(75) Inventors: Haruhisa Yamasaki, Gunma-ken (JP); Masaji Yamanaka, Tatebayashi (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 375 days.

(21) Appl. No.: 11/291,778

(22) Filed: Dec. 2, 2005

(65) Prior Publication Data

US 2006/0117789 A1 Jun. 8, 2006

(30) Foreign Application Priority Data

Dec. 7, 2004 (JP) ..... 2004-353839

(51) Int. Cl.
*A47F 3/04* (2006.01)
*F25D 19/00* (2006.01)

(52) U.S. Cl.
USPC ..... 62/255; 62/298

(58) Field of Classification Search ..... 62/298, 62/246, 302, 448, 6, 295
See application file for complete search history.

(56) References Cited

U.S. PATENT DOCUMENTS 4,977,754 A * 12/1990 Upton et al. ..... 62/248
5,417,079 A 5/1995 Rudick et al. ..... 62/253
6,550,255 B2 * 4/2003 Rudick et al. ..... 62/6
7,237,399 B2 * 7/2007 Iguchi et al. ..... 62/255
7,430,876 B2 * 10/2008 Iguchi et al. ..... 62/255
7,448,225 B2 * 11/2008 Iguchi et al. ..... 62/255

FOREIGN PATENT DOCUMENTS

| | | |
|---|---|---|
| EP | 1 439 356 | 7/2004 |
| EP | 1 562 012 | 8/2005 |
| ES | 2 115 433 | 6/1998 |
| JP | 2000-105060 | 4/2000 |
| WO | WO 03/056261 | 7/2003 |

* cited by examiner

*Primary Examiner* — John Pettitt
(74) *Attorney, Agent, or Firm* — Kratz, Quintos & Hanson, LLP

(57) ABSTRACT

An object is to improve an assembly operability while enhancing disconnecting and connecting properties between a main body and a refrigerating unit of a refrigerating device, and there is disclosed a refrigerating device (showcase) which is provided with a refrigerating unit including a refrigerant circuit constituted of a compressor, a radiator as a high-pressure-side heat exchanger, an evaporator as a low-pressure-side heat exchanger and the like and which supplies, by a blower, cold air subjected to heat exchange with the evaporator to a storage chamber as a space to be cooled constituted in a main body by a blower to cool the chamber, wherein a mechanical chamber is constituted under a bottom surface of the main body, the compressor and the radiator are installed on a unit base on the bottom surface of the mechanical chamber, and a refrigerating box in which the evaporator and the blower are stored is attached to the bottom surface of the main body via hooks so as to communicate with the storage chamber.

1 Claim, 6 Drawing Sheets

MODULAR REFRIGERATOR INSTALLED BY HOOKS

BACKGROUND OF THE INVENTION

The present invention relates to a refrigerating device provided with a refrigerating unit in which a refrigerant circuit is constituted of a compressor, a high-pressure-side heat exchanger, a low-pressure-side heat exchanger and the like.

In this type of conventional refrigerating device, for example, a showcase installed in a shop, a refrigerant circuit is constituted of a compressor, a radiator as a high-pressure-side heat exchanger, pressure reducing means, an evaporator as a low-pressure-side heat exchanger and the like. Moreover, a refrigerant gas compressed by the compressor at high temperature and pressure is discharged to the radiator. After heat is discharged from the refrigerant gas by radiation, the pressure is reduced by the pressure reducing means, and the gas is supplied to the evaporator. The refrigerant evaporates there, exchanges heat with an surrounding area, and is cooled at this time. The cooled air (cold air) is fed, by a blower, to a storage chamber (space to be cooled) formed in a main body to thereby cool the storage chamber (see, e.g., Japanese Patent Application Laid-Open No. 2000-105060).

Additionally, in a case where a trouble is generated in the above-described showcase or the like, or at a maintenance time, heretofore, a trouble portion has to be repaired or maintained in the store, or the whole showcase has to be once brought from a place where the showcase is installed back to a factory or the like to handle the trouble.

To solve such disadvantage, there has been developed a refrigerating device shown in FIGS. 4 and 5. In FIG. 4, reference numeral 201 denotes a main body constituted of a rectangular insulating box member 202 which opens in a front surface, a plurality of stages of shelves 203 . . . are built in the insulating box member 202, and a storage chamber 204 as a space to be cooled is constituted on each shelf. The opening in the front surface is openably closed by a door 209 rotatably supported with respect to the front surface of the insulating box member 202 and constituted of a transparent wall through which the inside can be seen.

Moreover, a bottom surface of the main body 201 is provided with a suction port 207 and a discharge port 208 which communicate with the inside of a mechanical chamber 206 constituted in a lower part, air in the storage chamber 204 is sucked from the suction port 207 into the mechanical chamber 206 by a blower 216, and air which has exchanged heat with an evaporator 215 is supplied from the discharge port 208 into the storage chamber 204 by the blower 216.

Here, in the mechanical chamber 206, there is disposed a refrigerating unit 217 including a refrigerant circuit constituted of a compressor 211, a radiator 212, the evaporator 215 disposed separately from the compressor 211 and radiator 212 via an insulating wall 221, the blower 216 for ventilating the evaporator 215 and the like. These components are installed on a unit base 220 (FIG. 5).

Walls 222, 223 each having hooks 224 on opposite ends are disposed on opposite sides of this unit base 220. These hooks 224 . . . are engaged with attaching portions (not shown) formed in the bottom surface of the main body 201, and detachably constituted. That is, the whole refrigerating unit 217 disposed on the unit base 220 can be detachably attached to the bottom surface of the main body 201 via the hooks 224.

Accordingly, when the respective hooks 224 . . . attached to the walls 222, 223 are engaged, the refrigerating unit 217 can be easily attached to the main body 201. Moreover, when the engagement is released, the refrigerating unit 217 can be easily separated from the main body 201. Therefore, repair or maintenance operability can be enhanced.

However, in a structure in which the whole refrigerating unit 217 is attached to the main body 201 as described above, the whole refrigerating unit 217 is suspended in the main body 201. Therefore, since the main body 201 is loaded with considerable component weights, strength of the main body 201 needs to be increased. Since the whole refrigerating unit 217 has considerable component weights as described above, there has also occurred a problem that an assembly operability in attaching the refrigerating unit 217 to the main body 201 drops.

SUMMARY OF THE INVENTION

The present invention has been developed to solve such conventional technical problem, and an object thereof is to improve an assembly operability while enhancing disconnecting and connecting properties of a main body and a refrigerating unit of a refrigerating device.

According to the present invention, there is provided a refrigerating device which is provided with a refrigerating unit including a refrigerant circuit constituted of a compressor, a high-pressure-side heat exchanger, a low-pressure-side heat exchanger and the like and which supplies, by a blower, cold air subjected to heat exchange with the low-pressure-side heat exchanger to a space to be cooled constituted in a main body to cool the space, wherein a mechanical chamber is constituted under a bottom surface of the main body, the compressor and the high-pressure-side heat exchanger are installed on a unit base on the bottom surface of the mechanical chamber, and a refrigerating box in which the low-pressure-side heat exchanger and the blower are stored is attached to the bottom surface of the main body so as to communicate with the space to be cooled.

Moreover, in the refrigerating device of the present invention, the refrigerating box is detachably attached to the bottom surface of the main body in the above-described invention.

Furthermore, in the refrigerating device of the present invention, a refrigerant pipe disposed between the compressor or the high-pressure-side heat exchanger on the unit base and the low-pressure-side heat exchanger in the refrigerating box is constituted of a flexible tube in the above-described inventions.

According to the present invention, the mechanical chamber is constituted under the bottom surface of the main body, and the compressor and the high-pressure-side heat exchanger are installed on the unit base on the bottom surface of the mechanical chamber, and the refrigerating box in which the low-pressure-side heat exchanger and the blower are stored is attached to the bottom surface of the main body so as to communicate with the space to be cooled. Therefore, weights of components attached to the bottom surface of the main body can be reduced, and assembly operability can be improved. Since a problem of strength of the main body is solved, costs can be reduced. Furthermore, since the compressor and the high-pressure-side heat exchanger are installed on the unit base, the center of gravity of the whole device is lowered and stabilized, and noises and vibrations can be reduced.

In addition, according to the present invention, since the refrigerating box is detachably attached to the bottom surface of the main body, an operation to attach the refrigerating box to the main body is facilitated more, and the refrigerating box can be detached at a maintenance time. Therefore, a maintenance managing operation is also facilitated.

Furthermore, in the present invention, in addition to the above-described inventions, since the refrigerant pipe disposed between the compressor or the high-pressure-side heat exchanger on the unit base and the low-pressure-side heat exchanger in the refrigerating box is constituted of the flexible tube, the refrigerating box can be attached to the main body without any trouble even in a state in which the refrigerant circuit is pipe-connected.

DETAILED DESCRIPTION OF THE PREFERRED EMBODIMENT

An embodiment of the present invention will be described hereinafter in detail with reference to the drawings.

Figure 1:
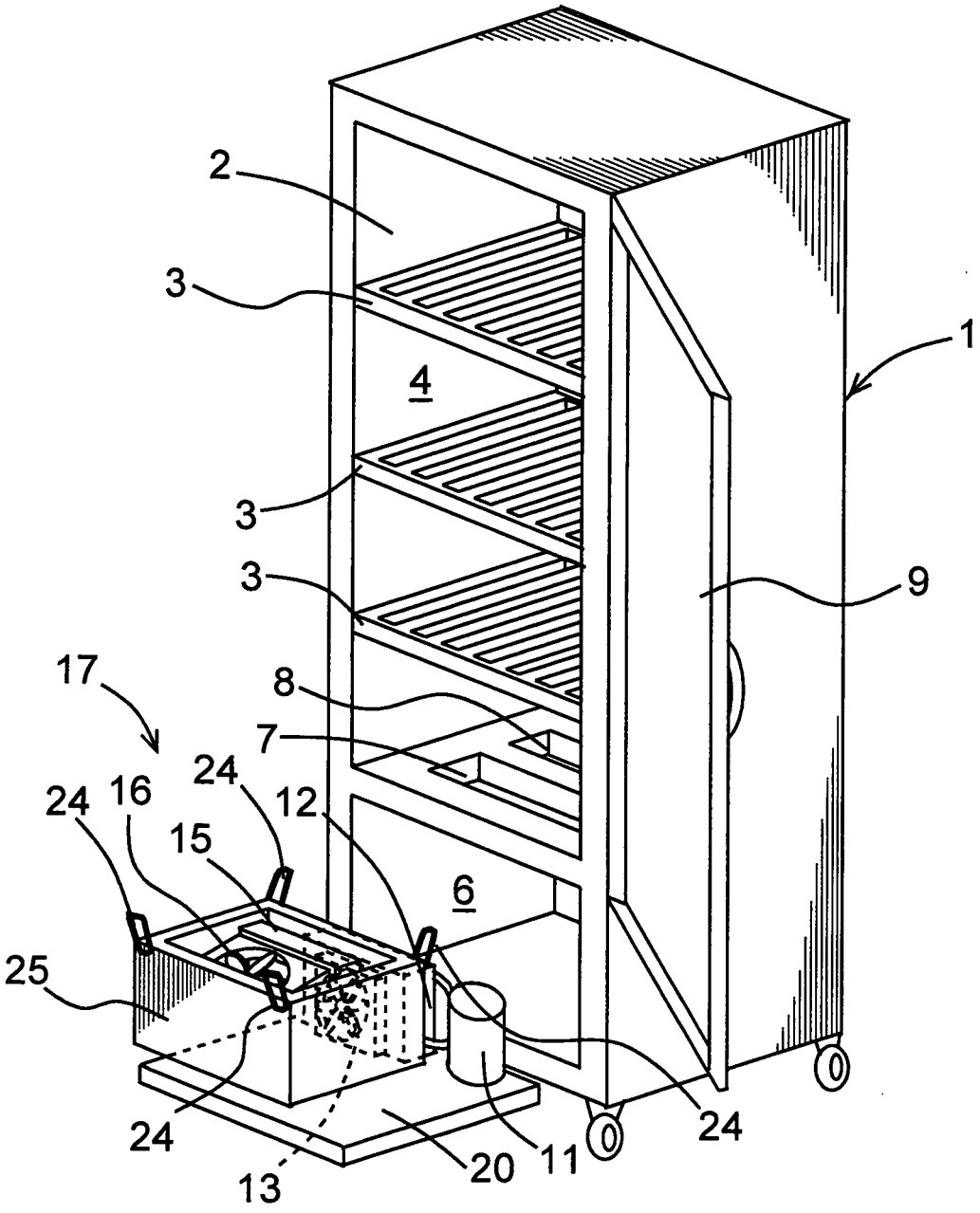
FIG. 1 is a perspective view of one embodiment in a case where a refrigerating device of the present invention is adapted to a showcase.
Figure 2:
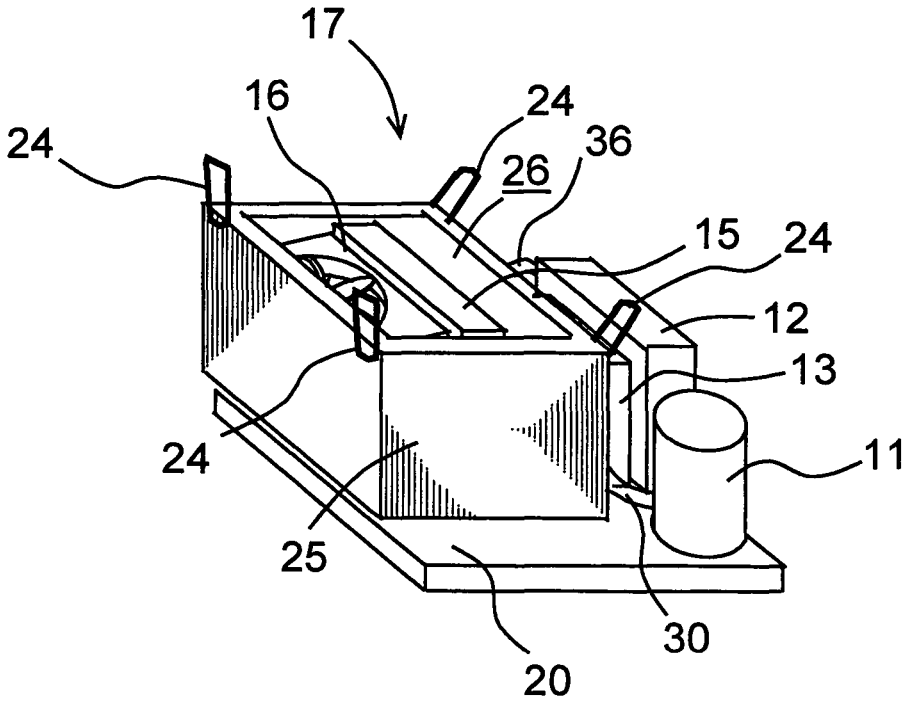
FIG. 2 is an enlarged view of a refrigerating unit of the showcase of FIG. 1.

FIG. 1 shows a perspective view of a case where a refrigerating device of the present invention is adapted to a showcase as one embodiment of the present invention, and FIG. 2 shows an enlarged view of a refrigerating unit 17 of the showcase, respectively. It is to be noted that the refrigerating device of the present invention is usable in the showcase, an automatic dispenser, a refrigerator, a freezer and the like.

In FIG. 1, reference numeral 1 denotes a main body of the showcase, and this main body 1 is constituted of a rectangular insulating box member 2 which opens in a front surface. A plurality of stages (three stages in the embodiment) of shelves 3 . . . are built in the insulating box member 2, and a space on each shelf is constituted as a storage chamber 4 as a space to be cooled. The opening in the front surface is openably closed by a door 9 rotatably supported on a right front surface of the insulating box member 2 and constituted of a transparent wall through which the inside can be seen.

Moreover, a bottom surface of the main body 1 is provided with a suction port 7 and a discharge port 8 which communicate with the inside of a mechanical chamber 6 constituted under the bottom surface of the main body 1, air in the storage chamber 4 is sucked from the suction port 7 into a refrigerating box 25 of the mechanical chamber 6 by a blower 16 described later, and air which has exchanged heat with an evaporator 15 as a low-pressure-side heat exchanger is supplied from the discharge port 8 into the storage chamber 4 by the blower.

Here, in the mechanical chamber 6, there are disposed: the refrigerating unit 17 including a refrigerant circuit constituted of a compressor 11, a radiator 12 as a high-pressure-side heat exchanger, a fan 13 for supplying air to the radiator 12, the evaporator 15 and the like; and the blower 16 for supplying cold air which has exchanged the heat with the evaporator 15 to the storage chamber 4 constituted in the main body 1 to cool the chamber.

Moreover, the compressor 11, the radiator 12, and the fan 13 are disposed on a unit base 20 attached to the bottom surface of the mechanical chamber 6. The evaporator 15 and the blower 16 are stored in the refrigerating box 25 described above. This refrigerating box 25 is an insulating box member whose upper surface opens, and the evaporator 15 and the blower 16 are stored in the refrigerating box 25 as described above. As shown in FIG. 2, a space 26 is disposed in the refrigerating box 25 on a side opposite to a side on which the blower 16 of the evaporator 15 is disposed, and an upper surface of this space 26 is formed in such a manner that the discharge port 8 described later is positioned.

Figure 6:
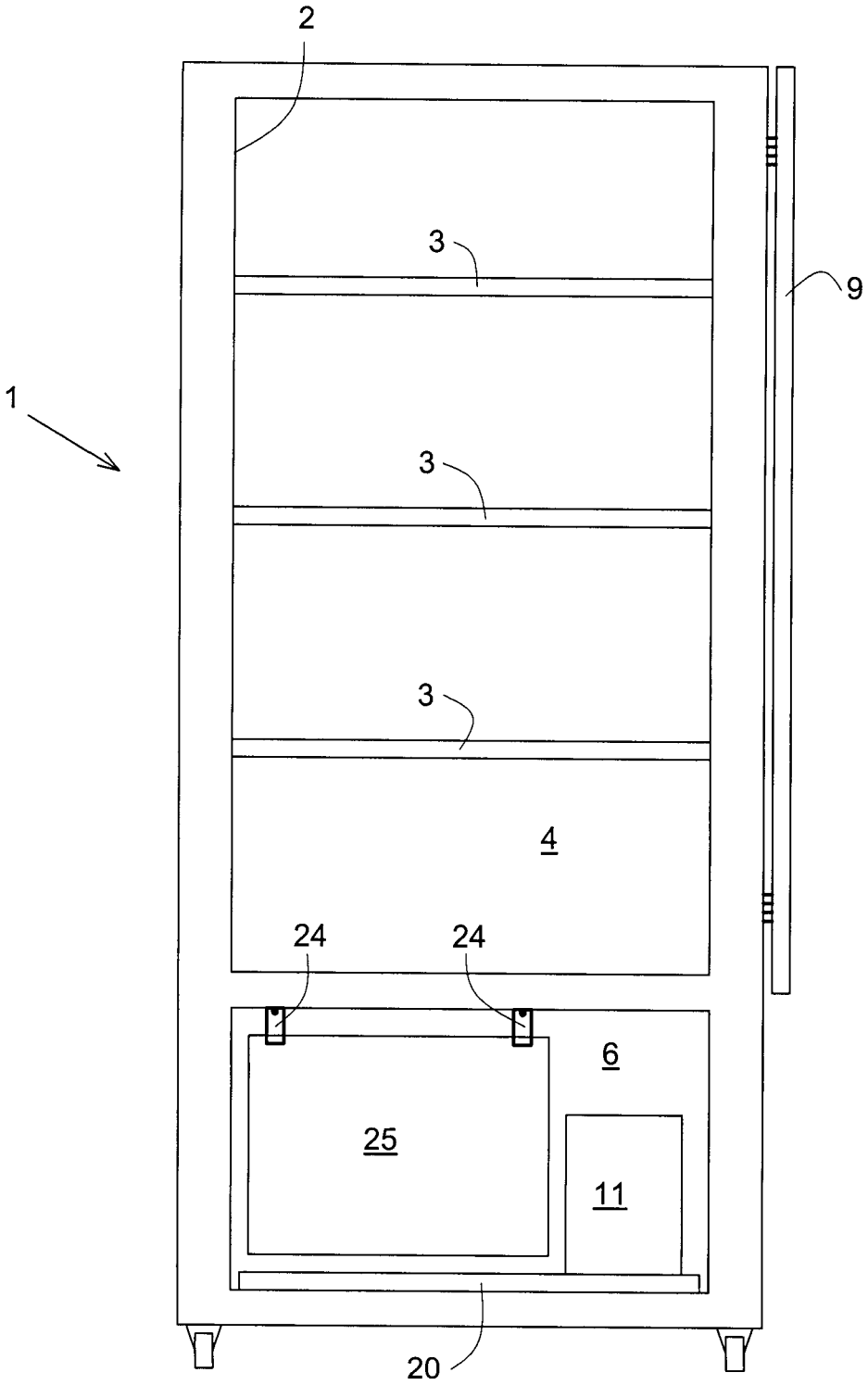
FIG. 6 is a front view of the embodiment of the invention shown in FIG. 1.

Hooks 24 are attached to corners of an upper part of the refrigerating box 25, respectively. The hooks 24 are formed so as to be engaged with attaching portions (not shown) formed in the bottom surface of the main body 1. When the respective hooks 24 are engaged with the attaching portions of the bottom surface of the main body 1, the refrigerating box 25 is attached to the bottom surface of the main body 1 in a suspended state, as shown in FIG. 6.

As described above, the refrigerating box 25 can be detachably attached to the bottom surface of the main body 1 via the respective hooks 24 . . . When the refrigerating box 25 is attached, the suction port 7 is positioned in the upper surface of the blower 16 in the refrigerating box 25, and the discharge port 8 is positioned in the upper surface of the space 26 formed between the evaporator 15 in the refrigerating box 25 and the refrigerating box 25. That is, the inside of the storage chamber 4 communicates with the upper surface of the blower 16 in the refrigerating box 25 via the suction port 7. Therefore, the air in the storage chamber 4 can be sucked from the suction port 7 into the blower 16 in the refrigerating box 25. The inside of the storage chamber 4 communicates with the space 26 formed on the side of the evaporator 15 opposite to the blower 16 via the discharge port 8. Accordingly, the cold air sucked by the blower 16 to exchange the heat with the evaporator 15 can be supplied from the discharge port 8 into the storage chamber 4.

Figure 3:
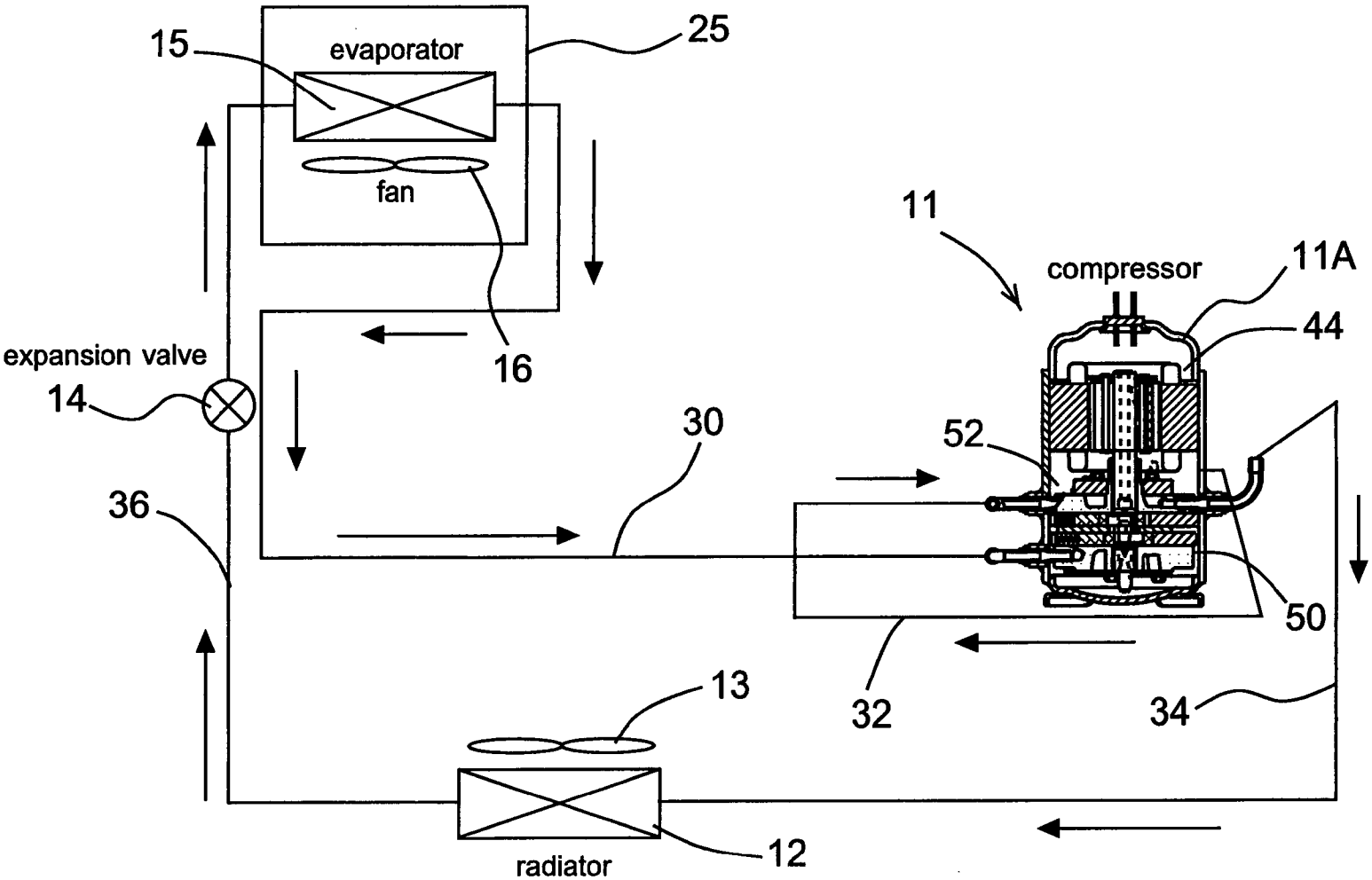
FIG. 3 is a refrigerant circuit diagram of the showcase of FIG. 1.
Figure 4:
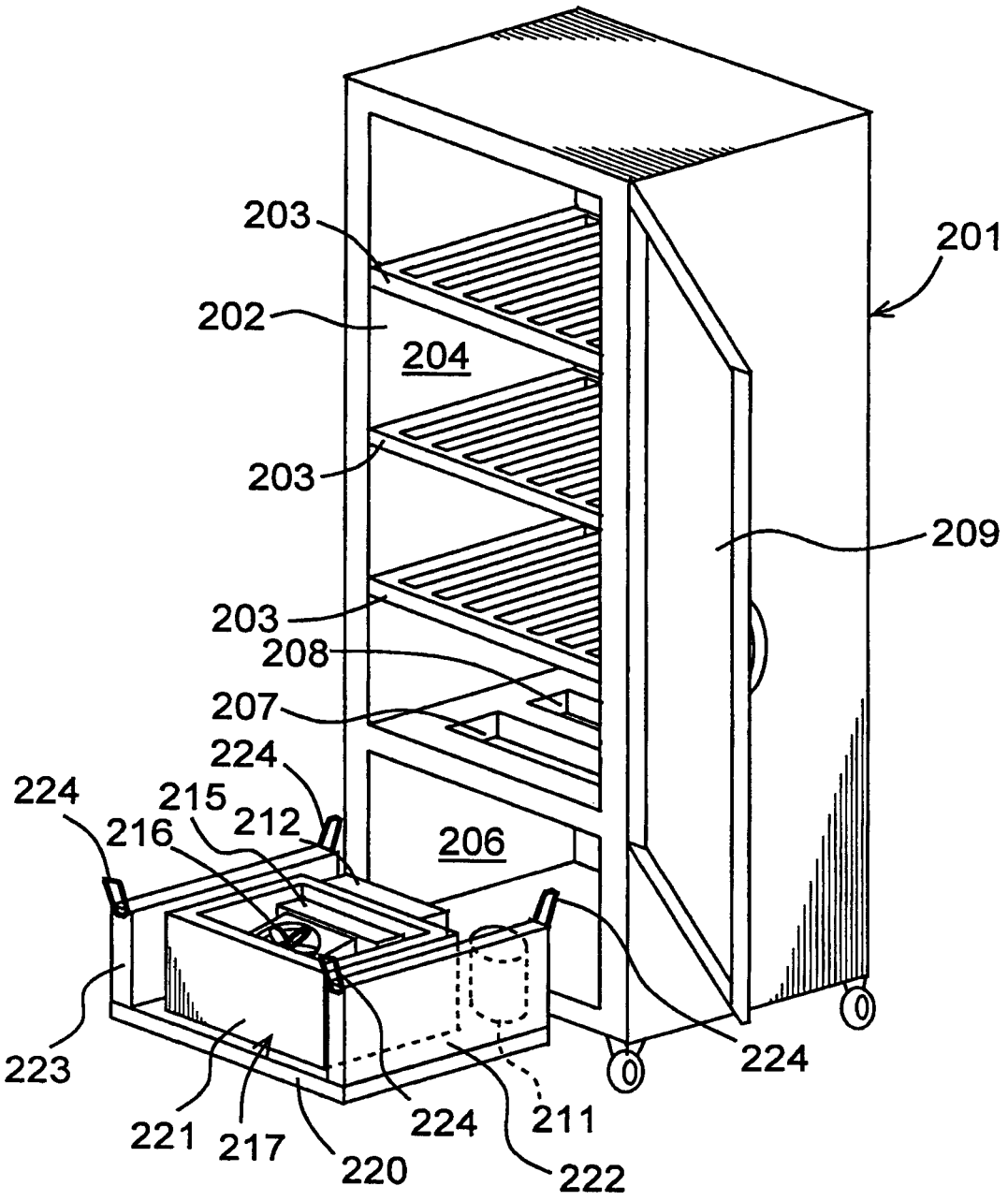
PRIOR ART FIG.4
FIG. 4 is a perspective view of a conventional showcase.
Figure 5:
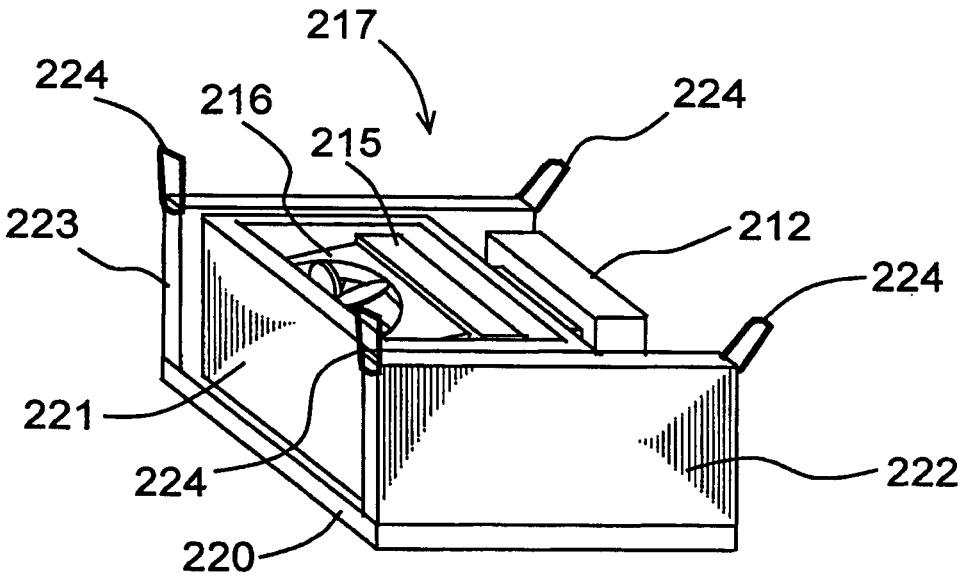
PRIOR ART FIG.5
FIG. 5 is an enlarged view of the refrigerating unit of the conventional showcase of FIG. 4.

Next, the refrigerant circuit will be described with reference to FIG. 3. The refrigerant circuit is constituted by connecting the compressor 11, the radiator 12, an expansion valve 14 as throttle means, the evaporator 15 and the like to one another in an annular form via pipes. That is, a refrigerant discharge pipe 34 of the compressor 11 is connected to an inlet of the radiator 12. Here, the compressor 11 of the present embodiment is an inner intermediate pressure type 2-stage compression system rotary compressor, and the compressor is constituted of a driving element 44, and first and second rotary compression elements 50, 52 driven by the driving element 44 in a sealed container 11A.

In the drawing, reference numeral 30 denotes a refrigerant introducing pipe for introducing a refrigerant into the first rotary compression element 50 of the compressor 11, and one end of this refrigerant introducing pipe 30 communicates with a cylinder (not shown) of the first rotary compression element 50. The other end of this refrigerant introducing pipe 30 is connected to an outlet side of the evaporator 15 stored in the refrigerating box 25.

In the drawing, reference numeral 32 denotes a refrigerant introducing pipe for introducing the refrigerant compressed by the first rotary compression element 50 into the second rotary compression element 52. The refrigerant discharge pipe 34 is a refrigerant pipe for discharging the refrigerant compressed by the second rotary compression element 52 to the radiator 12.

A refrigerant pipe 36 connected to an outlet side of the radiator 12 is connected to an inlet side of the evaporator 15 stored in the refrigerating box 25 via the expansion valve 14. The refrigerant introducing pipe 30 connected to the outlet side of the evaporator 15 is connected to the first rotary compression element 50 of the compressor 11.

Here, the refrigerant pipe 36 and the refrigerant introducing pipe 30 disposed between the compressor 11 or the radiator 12 installed on the unit base 20 and the evaporator 15 in the refrigerating box 25 are constituted of flexible tubes, respectively. That is, in the refrigerant circuit, the refrigerant pipe 36 which connects the radiator 12 installed on the unit base 20 to the evaporator 15 in the refrigerating box 25, and the refrigerant introducing pipe 30 which connects the evaporator 15 in the refrigerating box 25 to the compressor 11 installed on the unit base 20 are constituted of the flexible tubes having stretchability, resistant to vibration, and superior in durability. Consequently, the pipes can be connected without being disconnected or damaged even in a case where the refrigerant pipe 36 and the refrigerant introducing pipe 30 are subjected to an stretching operation. Therefore, the refrigerating box 25 can be attached to the main body 1 without any trouble even in a case where the refrigerant circuit is pipe-connected.

Here, there will be described a method of connecting the refrigerating box 25 to the main body 1 of the showcase. The refrigerating unit 17 pipe-connected beforehand and sealed with the refrigerant is constituted under the bottom surface of the main body 1 of the showcase, and set in the mechanical chamber 6. Moreover, the respective hooks 24 . . . of the refrigerating box 25 are engaged with the attaching portions (not shown) formed in the bottom surface of the main body 1. Accordingly, the refrigerating box 25 is attached to the bottom surface of the main body 1, the inside of the storage chamber 4 communicates with the upper surface of the blower 16 in the refrigerating box 25 via the suction port 7, and the inside of the storage chamber 4 communicates with the space 26 in the refrigerating box 25 via the discharge port 8.

Next, an operation of the showcase constituted by the above-described method will be described. When a start switch (not shown) disposed in the main body 1 is turned on, or a power socket of the main body 1 is connected to an outlet, operations of the fan 13 of the radiator 12 and the blower 16 are started to start the driving element 44 of the compressor 11. Accordingly, a low-pressure refrigerant is sucked into the first rotary compression element 50 of the compressor 11, and compressed to have an intermediate pressure, and discharged into the sealed container 11A. After the refrigerant discharged into the sealed container 11A is once discharged from the refrigerant introducing pipe 32 to the outside of the sealed container 11A, the refrigerant is sucked into the second rotary compression element 52 and compressed to form a high-temperature high-pressure refrigerant gas, and the gas is discharged from the refrigerant discharge pipe 34 to the outside of the compressor 11.

The high-temperature high-pressure refrigerant gas discharged to the outside of the compressor 11 flows from the refrigerant discharge pipe 34 into the radiator 12, and is subjected to ventilation by the fan 13 to radiate the heat there. Moreover, the refrigerant flows out of the radiator 12 to enter the refrigerant pipe 36, and reaches the expansion valve 14. A pressure of the refrigerant drops in the expansion valve 14, and the refrigerant in this state flows into the evaporator 15 stored in the refrigerating box 25. There the refrigerant evaporates, and exerts a cooling function by heat absorption from a surrounding area. It is to be noted that the air in the storage chamber 4 is sucked from the suction port 7 into the refrigerating box 25, and supplied to the evaporator 15 by means of the operation of the blower 16. Here, the air is cooled by the evaporation of the refrigerant, and the cooled air (cold air) is supplied from the space 26 into the storage chamber 4 via the discharge port 8. Moreover, the air is circulated in the storage chamber 4 to cool the inside of the storage chamber 4.

Here, since the evaporator 15 and the blower 16 are stored in the refrigerating box 25 having an insulating property, heat generated by the operation of the compressor 11, or air heated by heat exchange with the radiator 12 can be interrupted by the refrigerating box 25. Consequently, since the cold air that has exchanged the heat with the evaporator 15 can be supplied into the storage chamber 4 without being heated, a cooling efficiency can be enhanced.

It is to be noted that after the cold air supplied into the storage chamber 4 cools the inside of the storage chamber 4, the air is sucked from the suction port 7 into the blower 16 in the refrigerating box 25, and again cooled in the evaporator 15. This cycle is repeated.

On one hand, the refrigerant evaporated in the evaporator 15 flows out of the evaporator 15 to enter the refrigerant introducing pipe 30, and is sucked into the first rotary compression element 50 of the compressor 11. This cycle is repeated.

On the other hand, a disconnecting method will be described in a case where some trouble is generated in the refrigerating unit 17, or the refrigerating unit 17 is subjected to maintenance. When an operator presses a stop switch (not shown) disposed in the main body 1, or extracts the power socket from the outlet, the operation of the compressor 11 stops.

In this state, when the operator releases the engagement of the respective hooks 24 . . . on the bottom surface of the main body 1, the refrigerating box 25 can be easily detached from the main body.

Moreover, when the unit base 20 installed in a bottom part of the mechanical chamber 6 is entirely removed from the mechanical chamber 6, the refrigerating unit 17 can be removed.

As described above, the mechanical chamber 6 is constituted under the bottom surface of the main body 1, and the compressor 11 and the radiator 12 are installed on the unit base 20 on the bottom surface of the mechanical chamber 6. Moreover, the refrigerating box 25 in which the evaporator 15 and the blower 16 are stored is detachably attached to the bottom surface of the main body 1 via the hooks 24 . . . in such a manner that the refrigerating box communicates with the inside of the storage chamber 4 via the suction port 7 and the discharge port 8. Consequently, an operation to attach the refrigerating box 25 to the main body 1 can be more easily performed. Since the refrigerating box 25 can be detached at a trouble time or a maintenance time, such trouble can be quickly handled, and a maintenance managing operation can be easily performed.

Furthermore, since the refrigerating box 25, and the evaporator 15 and blower 16 stored in the refrigerating box 25 are attached to the bottom part of the main body 1, weights of the components attached to the bottom surface of the main body 1 can be reduced.

Consequently, an assembly operability can be improved. Furthermore, since a problem of strength of the main body 1 is also solved, costs can be reduced. Since the compressor 11 or the radiator 12 is installed on the unit base 20, the center of gravity of the whole showcase is lowered and stabilized. Moreover, since the compressor 11 is not attached to the bottom part of the main body 1, noises and vibrations generated from the compressor 11 are not easily transmitted to the main body 1. Consequently, the generation of the noises and vibrations of the showcase can be inhibited.

Furthermore, since the refrigerant pipe 36 and refrigerant introducing pipe 30 disposed between the compressor 11 or the radiator 12 on the unit base 20 and the evaporator 15 inside the refrigerating box 25 are constituted of the flexible tubes, the refrigerating box 25 can be attached to the main body 1 without any trouble even in a state in which the refrigerant circuit is pipe-connected.

It is to be noted that in the present embodiment, the inner intermediate pressure type 2-stage compression system rotary compressor is used as the compressor, but a compressor usable in the present invention is not limited to this compressor, another compressor system or a single-stage or three or more stages of compression elements may be provided.

What is claimed is:

1. A refrigerating device which is provided with a refrigerating unit including a refrigerant circuit comprised of a compressor, a high-pressure-side heat exchanger, and a low-pressure-side heat exchanger and which supplies, by a blower, cold air subjected to heat exchange with the low-pressure-side heat exchanger to an insulated space to be cooled, said insulated space being constituted in a main body, said refrigerating device to cool the insulated space, said refrigerating device comprising the main body structurally comprising an insulating top surface and an insulating bottom surface with an insulating back surface and opposing insulating side surfaces structurally connecting the insulating top surface and insulating bottom surface, and enclosing the insulated space to be cooled, a mechanical chamber structurally comprising a bottom surface with a back surface and opposing side surfaces structurally extending upwardly from the bottom surface, said mechanical chamber being disposed under the insulating bottom surface of the main body and structurally connected to the main body, the insulating bottom surface of the main body extending across the bottom of the main body to separate the main body from the mechanical chamber, in a vertical direction, said insulating bottom surface of the main body defining a suction port and a discharge port communicating with the mechanical chamber, a unit base, having disposed thereon the compressor and the high-pressure-side heat exchanger, said unit base being seated on the bottom surface of the mechanical chamber and spaced in a vertical direction from the bottom surface of the main body, and a refrigerating box, having hooks, in which the low-pressure-side heat exchanger and the blower are stored, said refrigerating box is not disposed on said unit base but is supported by the hooks from the insulating bottom surface of the main body so that substantially the entire weight of the refrigerating box and the stored low-pressure-side heat exchanger and blower is supported by the insulating bottom surface of the main body so as to communicate with the space to be cooled, wherein the refrigerating box is detachably attached by the hooks to the insulating bottom surface of the main body so as to be removable through a side surface of the mechanical chamber, and a refrigerant pipe disposed between the compressor or the high-pressure-side heat exchanger on the unit base and the low-pressure-side heat exchanger in the refrigerating box is constituted of a flexible tube that allows setting the refrigerating unit, pipe-connected beforehand and sealed with the refrigerant, in the mechanical chamber and then engaging the hooks of the refrigerating box with the bottom surface of the main body.

* * * * *